US007455494B2

(12) United States Patent
Krieger

(10) Patent No.: US 7,455,494 B2
(45) Date of Patent: Nov. 25, 2008

(54) CONTROL CIRCUIT FOR AN ATTACHMENT MOUNTING DEVICE

(75) Inventor: Daniel J. Krieger, Bismarck, ND (US)

(73) Assignee: Clark Equipment Company, Montvale, NJ (US)

( * ) Notice: Subject to any disclaimer, the term of this patent is extended or adjusted under 35 U.S.C. 154(b) by 376 days.

(21) Appl. No.: 11/293,431

(22) Filed: Dec. 2, 2005

(65) Prior Publication Data

US 2007/0128014 A1 Jun. 7, 2007

(51) Int. Cl.
*E02F 3/28* (2006.01)

(52) U.S. Cl. ..... 414/723; 37/468; 91/426

(58) Field of Classification Search ..... 414/723; 37/468; 172/272–275; 91/420, 426, 445, 91/446, 451

See application file for complete search history.

(56) References Cited

U.S. PATENT DOCUMENTS

| | | | | |
|---|---|---|---|---|
| 4,251,181 | A | 2/1981 | Drott et al. | 414/723 |
| 4,850,790 | A * | 7/1989 | Johnson et al. | 414/723 |
| 5,562,397 | A | 10/1996 | Albright | 414/723 |
| 6,132,131 | A | 10/2000 | Nakamura et al. | 403/322.1 |
| 6,231,296 | B1 | 5/2001 | Blomgren | 414/723 |
| 6,332,747 | B1 | 12/2001 | Lee | 414/723 |
| 6,390,765 | B1 | 5/2002 | Dick | 414/723 |
| 6,431,049 | B1 | 8/2002 | Berg et al. | |
| 6,773,223 | B2 * | 8/2004 | Harris et al. | 414/723 |
| 6,866,467 | B2 * | 3/2005 | Dvorak et al. | 414/723 |
| 2001/0051093 | A1 | 12/2001 | Riccardi | |
| 2003/0215320 | A1 | 11/2003 | Harris et al. | 414/723 |

FOREIGN PATENT DOCUMENTS

| | | |
|---|---|---|
| EP | 1473415 | 11/2004 |
| GB | 2335649 | 9/1999 |

OTHER PUBLICATIONS

PCT/US2006/045582 International Search Report dated Sep. 13, 2007.

* cited by examiner

*Primary Examiner*—Donald Underwood
(74) *Attorney, Agent, or Firm*—Leanne Taveggia Farrell; Westman, Champlin & Kelly, P.A.

(57) ABSTRACT

A control circuit for an attachment mounting device that has a closed position for securing an implement and an opened position for releasing an implement. The control circuit includes at least one hydraulic actuator, a control valve and an auto-close feature. The control valve has at least a first energized position and a second energized position. The first energized position applies pressurized fluid to the at least one hydraulic actuator to actuate the attachment mounting device into the closed position. The second energized position applies pressurized fluid to the at least one hydraulic actuator to actuate the attachment mounting device into the opened position. The auto-close feature is configured to be activated after the control valve is in the first energized position and is configured to be deactivated after the control valve is in the second energized position.

20 Claims, 5 Drawing Sheets

CONTROL CIRCUIT FOR AN ATTACHMENT MOUNTING DEVICE

BACKGROUND OF THE INVENTION

The present invention relates to a control circuit. More particularly, the present invention relates to a control circuit for an attachment mounting device.

Attachment mounting devices or implement couplers are carried on the front of a loader arm and are used for quickly attaching and detaching various accessories or tools, such as buckets, pallet forks, augers, etc. Attachment mounting devices have been used extensively by Bobcat Company, a business unit of, Ingersoll-Rand Company, and sold under the mark Bobtach™. These quick attachment devices have been utilized quite extensively for the ease of changing between attachments on a loader.

More recently, attachment mounting devices utilize power actuators to automatically power operate the attachment and detachment of the various implements or tools for a loader. In one example, a power actuator is connected to manual levers for power operating movable wedge members that are used for locking an attachment in place onto the attachment mounting device. The wedge members are movable from a retracted position, in which an attachment can be slipped onto the attachment mounting device, to a latched position, in which the wedge members are forced through an opening on a bracket on the implement to positively lock the implement to the quick attachment device. The power actuator is operated through a hydraulic circuit.

Attachment mounting devices incorporate various features. One such feature includes a portion of the hydraulic circuit that automatically enables the attachment mounting device into a closed position regardless of the last commanded motion. For example, if an operator commands the attachment mounting device to latch an implement to the loader arm by actuating the attachment mounting device into a closed position, the hydraulic circuit automatically keeps the attachment mounting device in a closed position. If an operator commands the attachment mounting device to unlock an attachment device by actuating the attachment mounting device into an open position, the hydraulic circuit can automatically close the quick attachment device after the command to open. The above-describe feature is undesirable when trying to change attachments efficiently and quickly. Occasionally the feature facilitates attachment mounting device closings that are of a nuisance.

SUMMARY OF THE INVENTION

The present invention provides a control circuit for an attachment mounting device. The attachment mounting device has a closed position for securing an implement to a loader arm and an opened position for releasing the implement from the loader arm. The control circuit includes at least one hydraulic actuator configured to actuate the attachment mounting device into the closed position and into the opened position. The control circuit also includes a control valve. The control valve has at least a first energized position and a second energized position. The first energized position applies pressurized fluid to the at least one hydraulic actuator to actuate the attachment mounting device into the closed position. The second energized position applies pressurized fluid to the at least one hydraulic actuator to actuate the attachment mounting device into the opened position. The control circuit also includes an auto-close feature. The auto-close feature is configured to be activated after the control valve is in the first energized position. The auto-close feature is also configured to be deactivated after the control valve is in the second energized position. The activated auto-close feature applies pressurized fluid to at least one hydraulic actuator to keep or revert the attachment mounting device into the closed position.

The present invention also provides an attachment mounting device for attaching an implement to a loader. The attachment mounting device has a closed position for securing the implement and an opened position for releasing the implement. The attachment mounting device includes a pair of wedges configured in an extendable position when the implement is attached to the attachment mounting device and configured in a retractable position when the implement is detached from the attachment mounting device. The attachment mounting device also includes at least one hydraulic actuator configured to actuate the pair of wedges from the extendable position to the retractable position. An auto-close feature is configured to keep the pair of wedges extended when activated and configured to keep the pair of wedges retracted when deactivated.

DETAILED DESCRIPTION OF THE PREFERRED EMBODIMENTS

Figure 1:
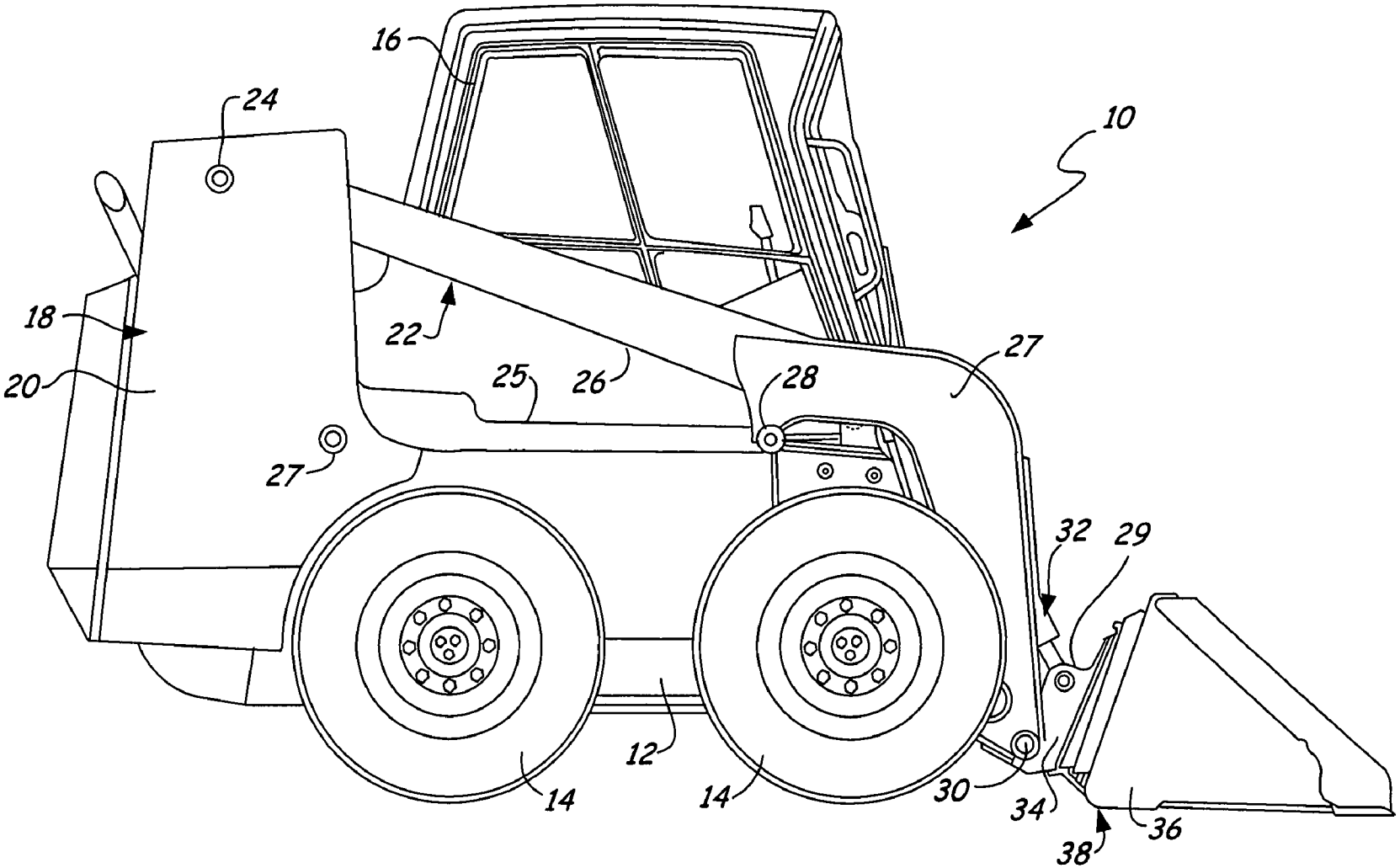
FIG. 1 is a side view of a loader in which embodiments of the present invention are useful.

FIG. 1 is a side view of a loader 10 in which embodiments of the present invention are useful. However, those skilled in the art should recognize that the present invention, which will be discussed in detail below, is useful in other types of wheeled work machines and tracked machines. Examples of wheeled work machines and tracked machines include compact excavators, riding power machines, such as skid steer loader 10 illustrated in FIG. 1, and walk-behind power machines. Skid steer loader 10 has a rigid frame assembly 12 and drive wheels 14 on left and right sides of the loader for engaging the ground and propelling the loader across the ground. Frame 12 supports an operator's cab 16 for housing an operator and an engine compartment 18 for housing a hydraulic power system (not shown in FIG. 1). Example components included in a hydraulic power system include an engine, a pump, a hydraulic reservoir and a valve block. The frame also includes frame plates 20 on which a lift arm assembly 22 is pivotally mounted on pivots 24.

Lift arm assembly 22 includes a pair of lift arms 26 on left and right sides of loader 10 and depending forearms 27 fixed to the forward or distal ends of lift arms 26. Lift arm assembly 22 is raised and lowered by pivoting the lift arm assembly about pivots 24 with actuators 25. Actuators 25 have base end pivots 27 connected to frame plates 20 and rod ends connected at pivots 28. Lift actuators 25 are extended and retracted by operator control in cooperation with the engine, pump and valve block located in the hydraulic power system.

Depending forearms 27 are connected to each other at pivot joint 30 and attachment mounting device 29 is coupled to depending forearms 27 at pivot joint 30. The tilting and mounting of implement 36 to attachment mounting device 29 is controlled by an actuator, the extendible and retractable rod of which is shown at 32 and attached to a suitable bracket 34. Attachment mounting device 29 is configured to mount or attach any of a variety of implements, such as implement 36, or attachments for temporary or permanent mounting. As depicted in FIG. 1, implement 36 is a bucket. However, implement 36 can be a wide variety of tools, such as a backhoe, a pallet fork, a breaker, an auger, a broom, etc. Attachment mounting device 29 and bucket 36 pivot together about pivots 30 and as a whole are labeled attachment member 38.

Figure 2:
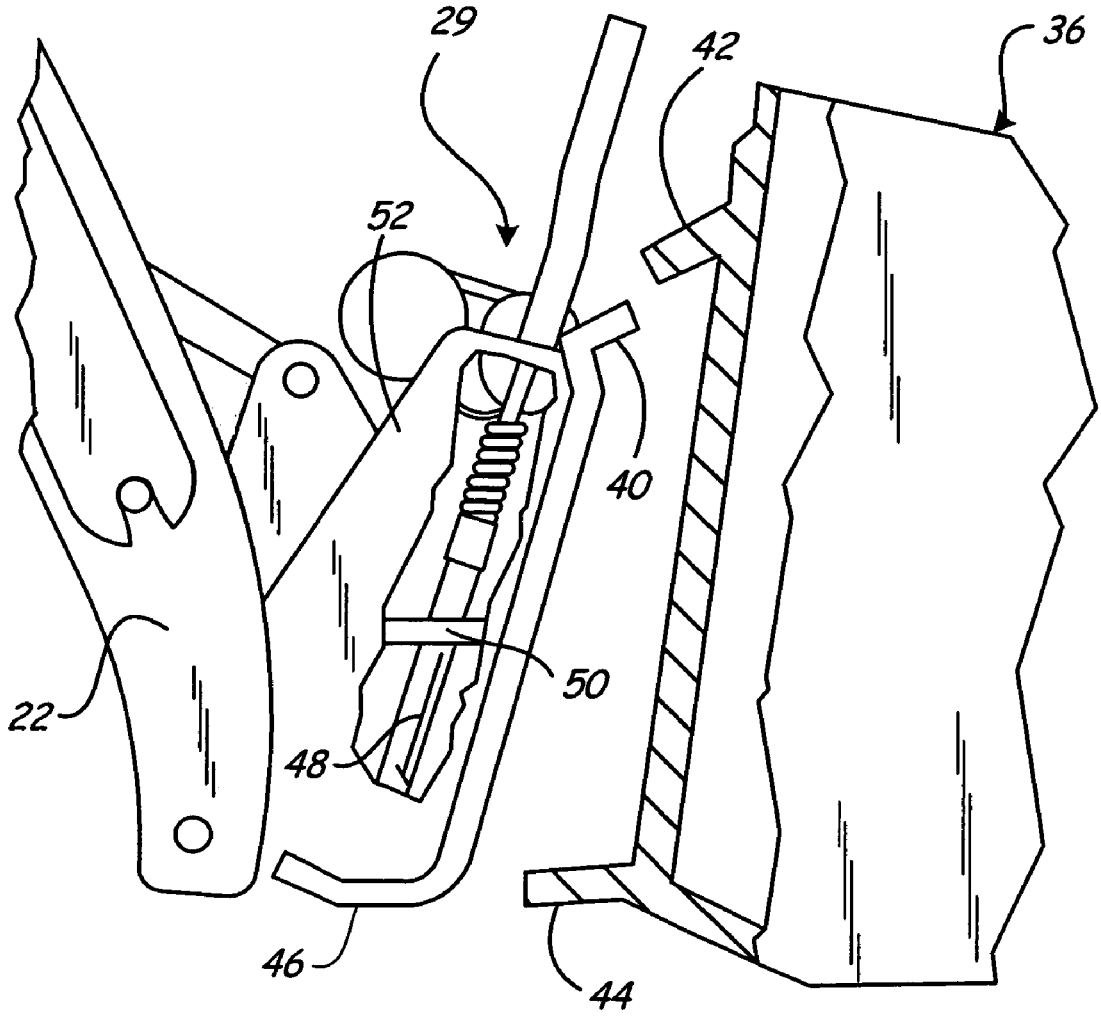
FIG. 2 is a side elevational view of an example attachment mounting device prior to being coupled to an implement.

FIG. 2 is a side elevational view of an example attachment mounting device 29 prior to being coupled to implement 36. As discussed above in FIG. 1, attachment mounting device 29 allows for the quick connection of implements or attachments to lift arm assembly 22. The example attachment mounting device 29 includes a lip 40 configured to fit under a flange 42 on implement 36. Implement 36 includes a lower support flange 44. Lower support flange 44 includes a pair of apertures that will align with a pair of apertures on a lower flange 46 of implement 36 (apertures are not shown in FIG. 2). A sliding wedge 48 is mounted in a suitable guide plate (or plates) 50 that forms part of a lever and wedge housing 52 on attachment mounting device 29. Wedges 48 will move up or down in a vertical direction to extend into or retract from desired apertures in attachment mounting device 29 and implement 36.

Figure 3:
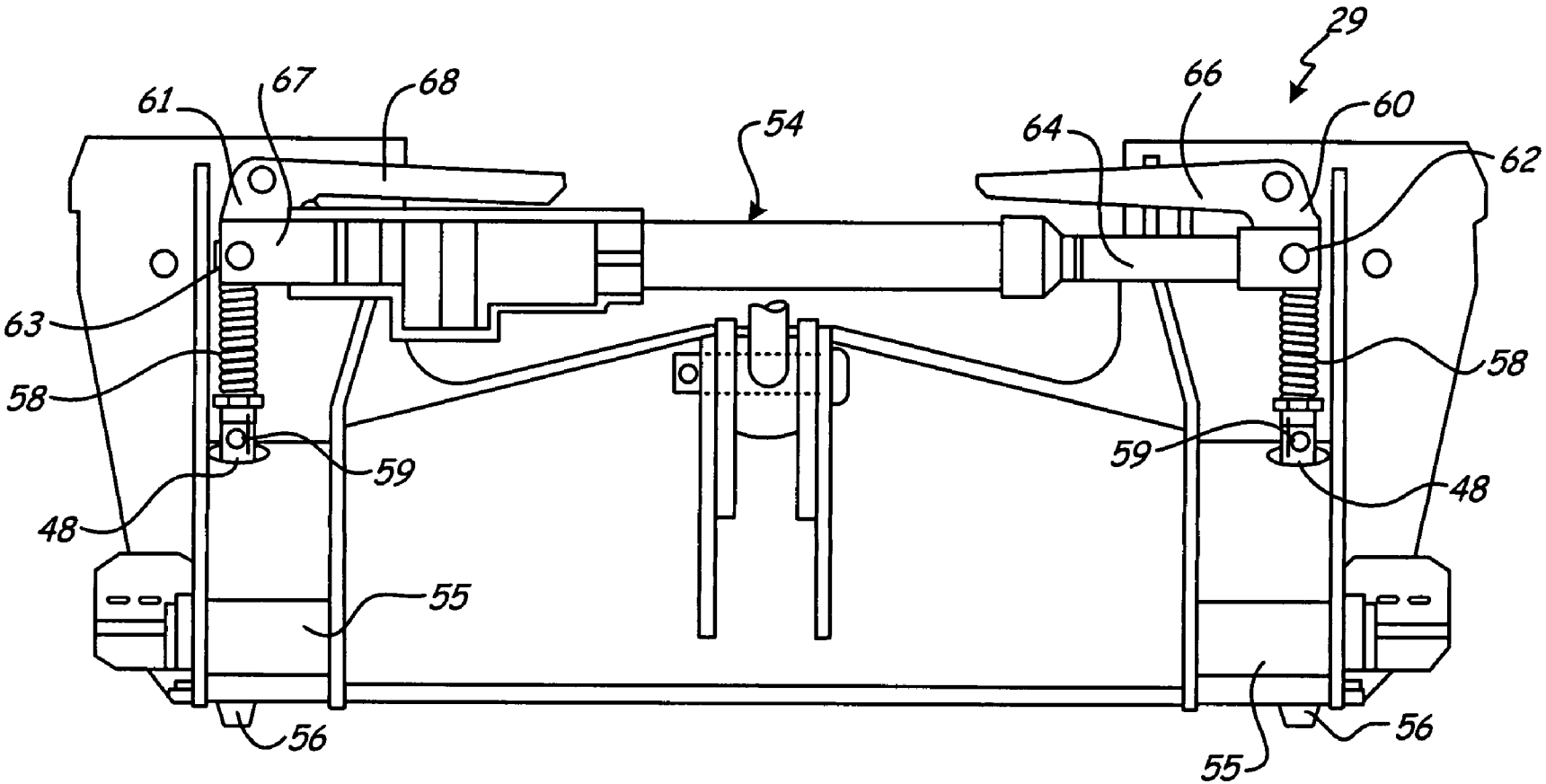
FIG. 3 is a front elevational view of the example attachment mounting device of FIG. 2 having a power actuator.

FIG. 3 is a front elevational view of the example attachment mounting device 29 having a power actuator 54. Attachment mounting device 29 is configured for coupling to a loader arm at cross beams 55 and configured for mounting an implement or attachment, such as implement 36 of FIGS. 1 and 2. In FIG. 3, attachment mounting device 29 is coupled to an implement.

Attachment mounting device 29 is configured to latch or lock implement 36 to a work vehicle with sliding wedges 48. Attachment mounting device 29 includes left and right wedges 48 that are slidable in suitable guides for vertical movement between latched and unlatched positions. Each wedge 48 is moved by a link 58 connected to an upper end of the respective wedge 48 at 59. Each link 58 is connected to a bell crank. One of the links 58 is connected to a right bell crank 60 with a pivot pin 62 and the other of the links 58 is connected to a left bell crank 61 with a pivot pin 63. Right bell crank 60 is integrally formed with lever 66 and left bell crank 61 is integrally formed with lever 68. Levers 66 and 68 allow attachment mounting device 29 to mount to an implement manually or hydraulically.

Pivot pins 62 and 63 are also used for mounting the opposite ends of a power actuator 54 that actuates wedges 48. Power actuator 54 can be a hydraulic type actuator. As illustrated in FIG. 3, actuator 54 is a double acting hydraulic actuator that includes a base end 64 that is coupled to lever 66 via pivot pin 62 and a rod end 67 coupled to lever 68 via pivot pin 63. In such an embodiment, base end 64 retracts both wedges 48 when both levers 66 and 68 are released such that attachment mounting device 29 is unlocked or unlatched from an implement. Rod end 67 extends both wedges 48 when levers 66 and 68 are latched such that attachment mounting device 29 is locked or latched to an implement. Although not illustrated in FIG. 3, those skilled in the art should recognize that attachment mounting device 29 can also include more than one actuator. If a pair of hydraulic actuators are utilized, then one of the hydraulic actuators can be configured to release and latch one of the wedges 48 and the other of the hydraulic actuators can be configured to release and latch the other of the wedges 48. The features of FIGS. 2 and 3 describe one type of configuration for mounting attachment mounting device 29 to implement 36. Other configurations for coupling attachment mounting device 29 and implement 36 are possible.

Figure 4:
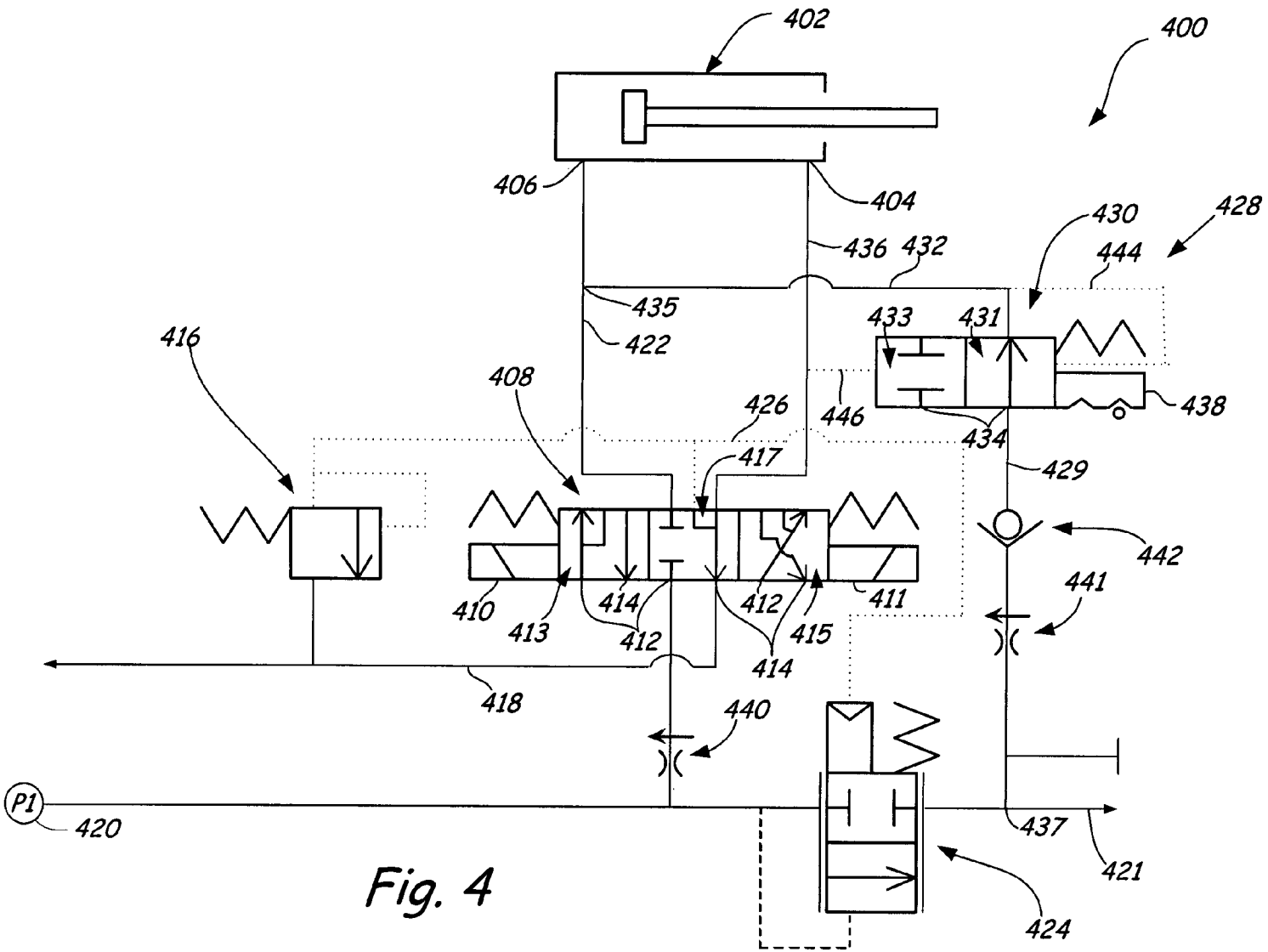
FIG. 4 is a simplified schematic diagram of a control circuit for use in engaging an implement with an attachment mounting device using a single actuator.

FIG. 4 is a simplified schematic diagram of a control circuit 400 for use in engaging an implement, such as implement 36 illustrated in FIGS. 1 and 2, and an attachment mounting device, such as attachment mounting device 29 illustrated in FIGS. 1, 2 and 3 in accordance with a disclosed embodiment. Control circuit 400 includes a double acting hydraulic actuator 402 configured to actuate attachment mounting device 29 into a closed position and into an opened position. Hydraulic actuator 402 includes a base end 406 and a rod end 404. In accordance with the embodiment illustrated in FIG. 4, the application of hydraulic pressure on the base end 406 of hydraulic actuator 402 extends wedges 48 (FIGS. 2 and 3) from their corresponding apertures in an implement. Therefore, both levers 66 and 68 (FIG. 3) are latched into a closed position by forcing the rod of the hydraulic actuator to extend from the cylinder. In accordance with the embodiment illustrated in FIG. 4, the application of hydraulic pressure on the rod end 404 of hydraulic actuator 402 retracts wedges 48 from their corresponding apertures in the implement. Therefore, both levers 66 and 68 are released into an open position by forcing the rod of the hydraulic actuator to retract into a cylinder. Those skilled in the art should recognize that other cylinder plumbing configurations for actuator 402 are possible. For example, a different plumbing configuration could apply hydraulic pressure on base end 406 to cause the attachment mounting device to be configured into an open position and apply hydraulic pressure on rod end 404 to cause the attachment mounting device to be configured into closed position.

Figure 5:
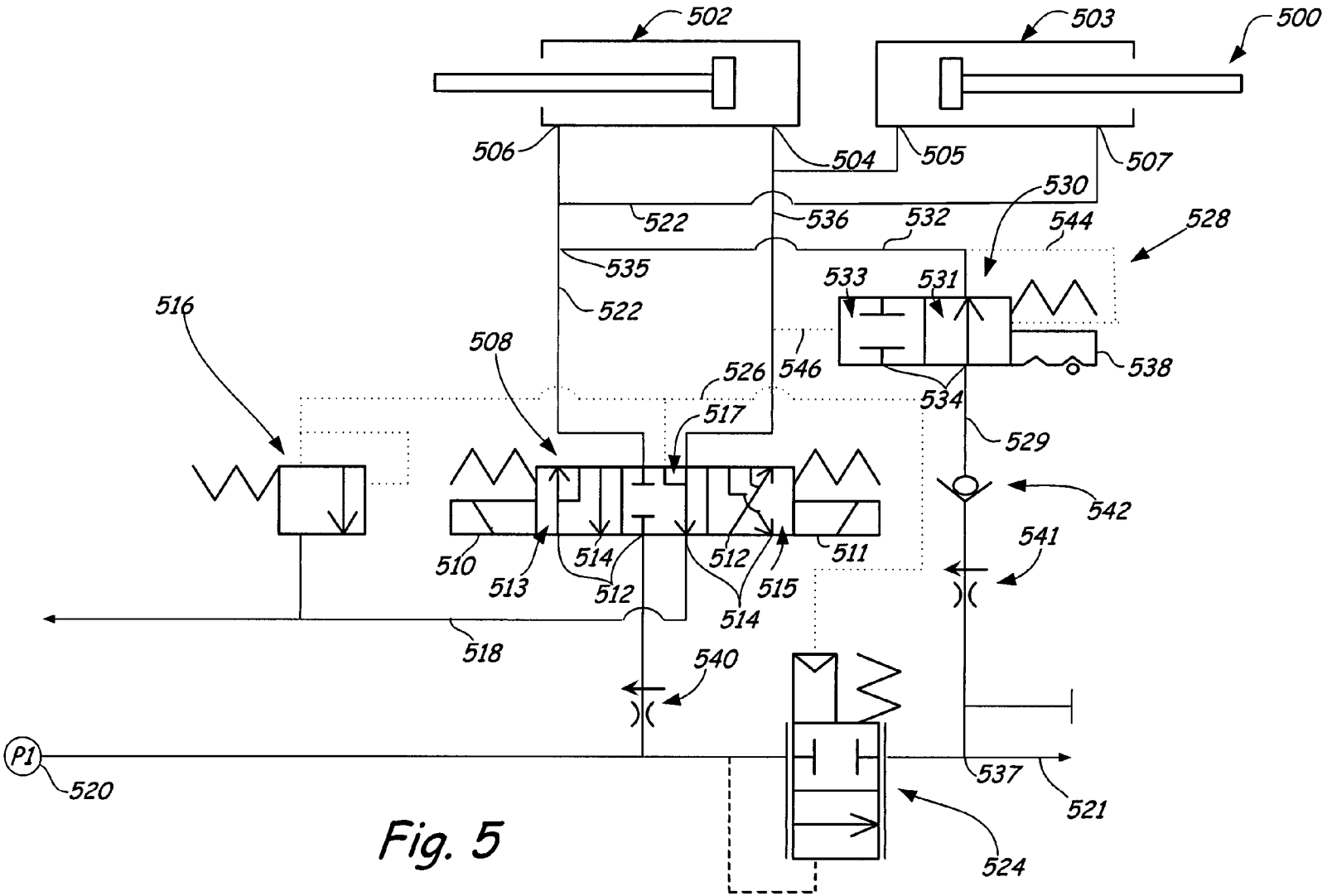
FIG. 5 is a simplified schematic diagram of a control circuit for use in engaging an implement with an attachment mounting device using a dual actuator.

FIG. 5 is a simplified schematic diagram of a control circuit 500 for use in engaging an implement, such as implement 36 illustrated in FIGS. 1 and 2 and an attachment mounting device, such as attachment mounting device 29 illustrated in FIGS. 1, 2 and 3, in accordance with a disclosed embodiment. Control circuit 500 includes a pair of double acting hydraulic actuators 502 and 503 configured to actuate attachment mounting device 29 into a closed position and into an opened position. Double acting hydraulic actuators 502 and 503 include base ends 504 and 505 and rod ends 506 and 507, respectively. Each hydraulic actuator is configured to actuate one of the wedges and therefore one of the corresponding levers, compared to a single hydraulic actuator actuating both of the wedges and therefore both of the corresponding levers as illustrated in FIG. 4. In accordance with the embodiment illustrated in FIG. 5, the application of hydraulic pressure on rod ends 506 and 507 of hydraulic actuators 502 and 503 retracts wedges 48 (FIGS. 2 and 3) from their corresponding apertures in an implement. Therefore, both levers 66 and 68 (FIG. 3) are released into an open position by forcing the rods of the hydraulic actuators to retract into each cylinder. In accordance with the embodiment illustrated in FIG. 5, the application of hydraulic pressure on base ends 504 and 505 of hydraulic actuators 502 and 503 extend wedges 48 into their corresponding apertures in the implement. Therefore, levers 66 and 68 are latched into a closed position by forcing the rods of the hydraulic actuators to extend from the cylinders. Those skilled in the art should recognize that other cylinder plumbing configurations for actuators 502 and 503 are possible. For example, a different plumbing configuration could apply hydraulic pressure on base ends 504 and 505 to cause the attachment mounting device to be configured into a closed position and apply hydraulic pressure on rod ends 506 and 507 to cause the attachment mounting device to be configured into an open position.

In general, control circuits for attachment mounting devices, similar to the ones illustrated in FIGS. 4 and 5, include an auto-close feature that is enabled regardless of the previous action that was taken. The auto-close features automatically actuate attachment mounting device 29 into a closed position regardless if the last commanded action was to close or to open the attachment mounting device. Control circuits 400 and 500 include auto-close features 428 and 528. For example, auto-close feature 428 is configured to automatically revert the attachment mounting device into a closed position after hydraulic pressure is applied on rod end 404 and configured to automatically keep the attachment mounting device in a closed position after hydraulic pressure is applied on the base end. In another example, auto-close feature 528 is configured to automatically revert the attachment mounting device into a closed position after hydraulic pressure is applied on base ends 504 and 505 and configured to automatically keep the attachment mounting device in a closed position after hydraulic pressure is applied on the rod ends 506 and 507.

Those skilled in the art should recognize that other actuator plumbing configurations for actuators 402, 502 and 503 are possible. In FIG. 4, the base side of actuator 402 is illustrated as being connected to auto-close feature indicating that the cylinder will be extended in an auto-close mode. In FIG. 5, the rod sides of actuators 502 and 503 are illustrated as being connected to an auto-close circuit indicating that the cylinder will be retracted in an auto-close mode. In other configurations, an auto-close circuit can be connected to a rod side of actuator 402 and connected to base sides of actuators 502 and 503. Control circuits 400 and 500 of the present invention are also configured to deactivate the auto-close feature. For example, if the last action taken was to open attachment mounting device 29, then the auto-close feature is deactivated such that the attachment mounting device will not automatically close after opening. The following description discusses detailed features of control circuits 400 and 500 as they relate to the disclosed embodiments.

Referring to FIG. 4, control circuit 400 includes a control valve 408 that is electrically actuated by electrical coils 410 and 411. Those skilled in the art will recognize that other actuation methods are possible. Control valve 408 has three positions (413, 415 and 417) and five ports. Two of the five ports include a pressure port (illustrated in the three positions at 412) and a tank port (illustrated in the three positions at 414). In a non-energized position 417 or neutral state, control valve 408 blocks pressure port 412 and allows hydraulic fluid from load sense relief valve 416 and hydraulic fluid from rod end 404 of hydraulic actuator 402 to drain through tank port 414 through drain passage 418 to a hydraulic tank (not illustrated in FIG. 4). Load sense relief valve 416 limits load sense pressure.

When electrical coil 410 becomes energized, a first energized position 413 of control valve 408 results. First energized position 413 allows hydraulic flow from pump 420 (or other source of pressurized flow), to be connected to hydraulic passage 422 and pilot signal passage 426. Pressure in pilot signal passage 426 is directed to dump valve 424 which builds sufficient pressure across control valve 408, into hydraulic passage 422, and to base end 406 of hydraulic actuator 402. Such a process configures attachment mounting device 29 (FIGS. 2 and 3) to be actuated into a closed position. In first energized position 413, hydraulic fluid from rod end 404 is allowed to drain through tank port 414 and through drain passage 418 to the hydraulic tank. An operator, such as an operator sitting in operator cab 16 of FIG. 1, has the option of specifying the flow direction required to actuate hydraulic actuator 402 into a closed position. After attachment mounting device 29 is actuated into a closed position, electrical coil 410 is de-energized (by the operator) and control valve 408 reverts back to its neutral state.

When electrical coil 411 becomes energized, a second energized position 415 of control valve 408 results. Second energized position 415 allows hydraulic fluid, pressurized by pump 420, to be applied to rod end 404 of hydraulic actuator 402 and through hydraulic passage 436, thereby configuring attachment mounting device 29 to be actuated into an open position. In other embodiments, however, hydraulic passage 436 can couple to a base end of the actuator. In second energized position 415, hydraulic fluid from rod end 406 is allowed to drain through tank port 414 and through drain passage 418 to the hydraulic tank. After attachment mounting device 29 is actuated into an open position, electrical coil 411 is de-energized (by the operator) and control valve 408 reverts back to its neutral state.

Auto-close feature 428 includes a sequence valve 430, a hydraulic passage 432 and a port passage 429. Port passage 429 includes a first end 437 that couples to passage 421. Hydraulic passage 432 connects sequence valve 430 to end 435 that couples to hydraulic passage 422. However, in other embodiments hydraulic passage 422 can couple to a passage connected to a rod end of the actuator.

Sequence valve 430 has two positions (first position 433 and second position 431). Sequence valve 430 is actuated by two pilot signal passages (444 and 446). Pilot signal passage 444 connects passage 432 to the first end of sequence valve 430 and acts to move sequence valve 430 into first position 433. Pilot signal 446 connects passage 436 to the second end of sequence valve 430 and acts to move sequence valve 430 into second position 431.

When sequence valve 430 is in first position 433, the auto-close feature 428 is activated. When sequence valve 430 is in second position 431, the auto-close feature 428 is de-activated. In second position 431, sequence valve 430 prevents flow in passage 429 from passage 432, thus disabling the auto-close feature 428.

In addition, sequence valve 430 of auto-close feature 428 also includes a detent 438. Detent 438 acts to hold sequence valve 430 into first position 433 or second position 431. When detent 438 is in a first detent position, sequence valve 430 is held in its first position 433 and auto-close feature 428 is activated, which connects passage 429 to passage 432 and can provide flow to hydraulic actuator 402 to configure attachment mounting device 29 into a closed position. When detent 438 is in a second detent position sequence valve 430 is held in its second position 431 and auto-close feature 428 is de-activated, thus preventing pressurized fluid from automatically actuating hydraulic actuator 402 into a closed position.

Hydraulic circuit 400 includes other features such as pressure compensation flow controls 440 and 441 and non-return valve 442. Flow controls 440 and 441 provide some control as to the amount of pressure supplied to hydraulic actuator 402, while non-return valve 442 prevents fluid from draining towards passage 421.

Referring to FIG. 5, control circuit 500 includes a control valve 508 similar to control valve 408 of hydraulic circuit 400. Those skilled in the art will recognize that other actuation methods are possible. Like control valve 408, control valve 508 includes three positions (513, 515 and 517) and five ports (two of which include a pressure port illustrated in the three different positions at 512 and a tank port illustrated in the three different positions at 514). Control valve 508 includes a non-energized position 517 or neutral state that blocks pressure port 512 and allows hydraulic fluid from load sense relief valve 516 and hydraulic fluid from base ends 504 and 505 of hydraulic actuators 502 and 503 to drain through tank port 514 through drain passage 518 to a hydraulic tank (not illustrated in FIG. 5).

When electrical coil 510 becomes energized, a first energized position 513 of control valve 508 results. First energized position 513 allows hydraulic flow from pump 520 (or other source of pressurized flow), to be connected to hydraulic passage 522 and pilot signal passage 526. Pressure in pilot signal passage 526 is directed to dump valve 524 which builds sufficient pressure across control valve 508 into passage 522 to rod ends 506 and 507 of hydraulic actuators 502 and 503, thereby configuring attachment mounting device 29 (FIGS. 2 and 3) to be actuated into a closed position. In first energized position 513, hydraulic fluid from base ends 504 and 505 is allowed to drain through tank port 514 and through drain passage 518 to the hydraulic tank. An operator, such as an operator sitting in operator cab 16 of FIG. 1, has the option of specifying the flow direction required to actuate hydraulic actuators 502 and 503 into closed positions. After attachment mounting device 29 is actuated into a closed position, electrical coil 510 is de-energized (by the operator) and control valve 508 reverts back to its neutral state.

When electrical coil 511 becomes energized, a second energized position 515 of control valve 508 results. Second energized position 515 allows hydraulic fluid, pressurized by pump 520, to be applied to base ends 504 and 505 of hydraulic actuators 502 and 503 through base end hydraulic passage 536, thereby configuring attachment mounting device 29 to be actuated into an open position. In other embodiments, however, hydraulic passage 536 can couple to a rod end of an actuator. In second energized position 515, hydraulic fluid from rod ends 505 and 507 are allowed to drain through tank port 514 and through drain passage 518 to the hydraulic tank. After attachment mounting device 29 is actuated into an open position, electrical coil 511 is de-energized (by the operator) and control valve 508 reverts back to its neutral state.

Auto-close feature 528 includes a sequence valve 530, a hydraulic passage 532 and a port passage 529. Port passage includes a first end 537 that couples to passage 521. Hydraulic passage 532 connects sequence valve 530 to end 535 that couples to hydraulic passage 522. In other embodiments, however, passage 532 can couple to a base end of an actuator.

Sequence valve 530 has two positions (first position 533 and second position 531). Sequence valve 530 is actuated by two pilot signal passages (544 and 546). Pilot signal passage 544 connects passage 532 to the first end of sequence valve 530 and acts to move sequence valve 530 into first position 533. Pilot signal 546 connects passage 536 to the second end of sequence valve 530 and acts to move sequence valve 530 into second position 531.

When sequence valve 530 is in first position 533, the auto-close feature 528 is activated. When sequence valve is in second position 531, the auto-close feature 528 is de-activated. In second position 531, sequence valve 530 prevent flow in passage 529 from passage 532, thus disabling auto-close feature 528.

In addition, sequence valve 530 of auto-close feature 528 includes a detent 538. Detent 538 acts to hold sequence valve 530 into first position 533 or second position 531. When detent 538 is in a first detent position, sequence valve 530 is held in its first position 533 and auto-close feature 528 is activated, which connects passage 532 to passage 529 and can provide flow to hydraulic actuators 502 and 503 to configure attachment mounting device 29 into a closed position. When detent 538 is in a second detent position, sequence valve 530 is held in its second position 531 and the auto-close feature 528 is activated, thus preventing pressurized fluid to automatically actuate hydraulic actuators 502 and 503 into a closed position.

Hydraulic circuit 500 includes other features such as pressure compensation flow controls 540 and 541 and non-return valve 542. Flow controls 540 and 541 provide some control as to the amount of pressure supplied to hydraulic actuators 502 and 503, while non-return valve 542 prevents fluid from draining towards passage 521.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A control circuit for an attachment mounting device, the attachment mounting device having a closed position for securing an implement to the attachment mounting device and an opened position for releasing the implement from the attachment mounting device, the control circuit comprising:

at least one hydraulic actuator configured to actuate the attachment mounting device into the closed position and into the opened position;

a control valve having at least a first energized position and a second energized position, wherein the first energized position applies pressurized fluid to the at least one hydraulic actuator to actuate the attachment mounting device into the closed position and wherein the second energized position applies pressurized fluid to the at least one hydraulic actuator to actuate the attachment mounting device into the opened position; and a continuous pressure valve configured into a first position to keep the at least one hydraulic actuator actuating the attachment mounting device in the closed position when the control valve was last operated into-the first energized position and configured into a second position to keep the at least one hydraulic actuator actuating the attachment mounting device in the opened position when the control valve was last operated into the second energized position.

2. The control circuit of claim 1, wherein the continuous pressure valve comprises a sequence valve.

3. The control circuit of claim 2, wherein the sequence valve further comprises a detent, the detent is configured to hold the sequence valve in one of the first and the second positions.

4. The control circuit of claim 2, wherein the sequence valve comprises a first pilot line and a second pilot line that energize the sequence valve into a selected one of the first position and the second position based on whether the last commanded movement of the operator was to put the control valve in the first energized position or the second energized position.

5. The control circuit of claim 4, wherein the first pilot line connects a hydraulic passage coupleable to the at least one hydraulic actuator to the sequence valve to move the sequence valve into the first position when the last commanded movement of the operator was to place the control valve into the first energized position.

6. The control circuit of claim 4, wherein the second pilot line connects a hydraulic passage coupleable to the at least one hydraulic actuator to the sequence valve to move the sequence valve into the second position when the last commanded movement of the operator was to actuate the attachment mounting device into the opened position.

7. The control circuit of claim 1, wherein the control valve further comprises a neutral position that the control valve reverts into after either operated into the first energized position or operated into the second energized position, wherein the control valve in the neutral position allows hydraulic fluid from a sense relief valve and from the last one hydraulic actuator to drain to a hydraulic tank to limit load sense pressure.

8. The control circuit of claim 1, wherein when the continuous pressure valve is in the first position, the continuous pressure valve applies hydraulic fluid to the at least one hydraulic actuator to keep the attachment mounting device in the closed position.

9. The control circuit of claim 1, wherein the at least one hydraulic actuator is configured to actuate a pair of wedges into an extendable position for the attachment mounting device to be in the closed position and configured to actuate the pair of wedges into a retractable position for the attachment mounting device to be in the opened position.

10. The control circuit of claim 1, wherein the actuation device comprises a pair of hydraulic actuators.

11. The control circuit of claim 10, wherein each hydraulic actuator is configured to actuate one of a pair of wedges into an extendable position for the attachment mounting device to be in the closed position and configured to actuate one of the pair of wedges into a retractable position for the attachment mounting device to be in the opened position.

12. An attachment mounting device for attaching an implement to a loader arm, the attachment mounting device having a closed position for securing the implement and an opened position for releasing the implement, the attachment mounting device comprising:

a pair of wedges configured in an extendable position when the implement is attached to the attachment mounting device and configured in a retractable position when the implement is detached from the attachment mounting device;

at least one hydraulic actuator configured to actuate the pair of wedges from the extendable position to the retractable position; and a continuous pressure sequence valve configured into a first position to keep the at least one hydraulic actuator extending the pair of wedges when the at least one hydraulic actuator was last operated to extend the pair of wedges and configured into a second position to keep the at least one hydraulic actuator retracting the pair of wedges when the at least one hydraulic actuator was last operated to retract the pair of wedges.

13. The attachment mounting device of claim 12, continuous pressure sequence valve comprises a detent, the detent, the detent configured to hold the sequence valve in one of the first and second positions.

14. The attachment mounting device of claim 12, further comprising a first pilot line and a second pilot line that energize the continuous pressure sequence valve into a selected one of the first position and the second position based on whether the last commanded movement of the operator was to extend the pair of wedges or to retract the pair of wedges.

15. The attachment mounting device of claim 14, wherein the first pilot line connects a hydraulic passage coupleable to the at least one hydraulic actuator to the continuous pressure sequence valve to move the sequence valve into the first position when the last commanded movement of the operator was to extend the pair of wedges.

16. The attachment mounting device of claim 15, wherein the hydraulic passage is coupleable to one of a base end and a rod end of the at least one actuator.

17. The attachment mounting device of claim 14, wherein the second pilot line connects a hydraulic passage coupleable to the at least one hydraulic actuator to the continuous pressure sequence valve to move the continuous pressure sequence valve into the second position when the last command movement of the operator was to retract the pair of wedges.

18. The attachment mounting device of claim 17, wherein the hydraulic passage is coupleable to one of a base end and a rod end of the at least one actuator.

19. The attachment mounting device of claim 12 and farther comprising a control valve having at least a first energized position and a second energized position, wherein the first energized position applies pressurized fluid to the at least one hydraulic actuator to attach the implement to the attachment mounting device and wherein the second energized position applies pressurized fluid to the at least one hydraulic actuator to detach the implement from the attachment mounting device.

20. A control circuit for an attachment mounting device, the attachment mounting device having a closed position for securing an implement to the attachment mounting device and an opened position for releasing the implement from the attachment mounting device, the control circuit comprising:

at least one hydraulic actuator configured to actuate the attachment mounting device into the closed position and into the opened position;

a control valve having at least a first energized position and a second energized position, wherein the first energized position applies pressurized fluid to the at least one hydraulic actuator to actuate the attachment mounting device into the closed position and wherein the second energized position applies pressurized fluid to the at least one hydraulic actuator to actuate the attachment mounting device into the opened position; and a continuous pressure valve configured into a first position to keep the at least one hydraulic actuator actuating the attachment mounting device in the closed position when the control valve was last operated into the first energized position and the continuous pressure valve configured into a second position to prevent the attachment mounting device from reverting into the closed position when the control valve was last operated into the second energized position, the continuous pressure valve further comprising a detent, the detent configured to hold the continuous pressure valve in one of the first and the second positions.

* * * * *